United States Patent [19]

Deutsch

[11] 4,100,831

[45] Jul. 18, 1978

[54] AUTOMATIC DIGITAL CIRCUIT FOR GENERATING CHORDS IN A DIGITAL ORGAN

[75] Inventor: Ralph Deutsch, Sherman Oaks, Calif.

[73] Assignee: Kawai Musical Instrument Mfg. Co., Ltd., Hamamatsu, Japan

[21] Appl. No.: 712,736

[22] Filed: Aug. 9, 1976

[51] Int. Cl.[2] ..... G10H 1/00; G10H 3/06

[52] U.S. Cl. ..... 84/1.01; 84/1.17; 84/DIG. 2; 84/DIG. 22

[58] Field of Search ..... 84/1.01, 1.03, 1.19, 84/1.17, DIG. 2, DIG. 8, DIG. 18, DIG. 22

[56] References Cited

U.S. PATENT DOCUMENTS

| | | | |
|---|---|---|---|
| 3,715,442 | 2/1973 | Freeman | 84/1.01 |
| 3,789,718 | 2/1974 | Bunger | 84/1.01 |
| 3,844,192 | 10/1974 | Brand | 84/DIG. 22 |
| 3,889,568 | 6/1975 | Amaya | 84/1.03 |
| 3,954,039 | 5/1976 | Southard | 84/1.01 |
| 4,019,417 | 4/1977 | Carlson | 84/1.17 |

*Primary Examiner*—Edith S. Jackmon

*Attorney, Agent, or Firm*—Christie, Parker & Hale

[57] ABSTRACT

An automatic chord generating circuit for a digital polyphonic tone synthesizer having one or more keyboards. Key operated switches are connected in groups corresponding to the notes in an octave. A signal source is selectively connected by the closed switches of each group in sequence to associated ones of a plurality of signal lines. A priority circuit selectively connects a signal from only one line at a time to a corresponding one of a plurality of output lines, so that operation of more than one key in an octave produces only one output signal at a time. A switching logic circuit, responsive to digitally coded input signals identifying any one of a plurality of different chords, connects the single output signal from the priority circuit to additional ones of the output lines for activating multiple notes within the octave.

6 Claims, 3 Drawing Figures

AUTOMATIC DIGITAL CIRCUIT FOR GENERATING CHORDS IN A DIGITAL ORGAN

FIELD OF THE INVENTION

This invention relates to electronic digital computer organs, and more particularly, is concerned with an automatic chord generating circuit.

BACKGROUND OF THE INVENTION

In my copending application, Ser. No. 603,776 filed Aug. 11, 1975, entitled "Polyphonic Tone Synthesizer", now issued as U.S. Pat. No. 4,085,644 there is described an electronic keyboard instrument in which each key initiates a tone whose waveform is generated from digitally computed data. In copending application Ser. No. 619,615, filed Oct. 6, 1975, issued as U.S. Pat. No. 4,022,098 entitled "keyboard Switch Detect and Assignor", there is described a system for detecting the change of state of key-operated switches and causing a number of tone generation system to be assigned or unassigned in response to detected key state changes. Groups of key-operated switches, each group corresponding to the standard twelve keys in an octave, are sequentially scanned to detect a change in the state of the key switch as in each group. Information on the octave and keyboard of each depressed key and the assignment status of the key to a tone generator is stored in memory during an assignment mode. By having more than one tone generator, more than one tone can be generated at a time in response to more than one key at a time.

In the past various systems have been used in conjunction with electronic organs for generating complete chords in response to actuating a single key or manually controlled switch. So-called chord organs simplify the execution of more complex musical arrangements with a minimum of training. The present invention is directed to a digital circuit for implementing automatic chord generation in a digital computer organ with a keyboard switch detect and assignor circuit of the type described in the above-identified patent application.

SUMMARY OF THE INVENTION

The circuit of the present invention is characterized by its relative simplicity and in being able to generate chords in any octave and any of the manual or pedal keyboards of the instrument. In brief, the present invention provides a chord generating circuit for a keyboard instrument having a plurality of keys arranged in separate divisions. The switches associated with the keys of the respective divisions are connected in groups, each group corresponding to all the notes in one octave. When depressed, each key in a group connects a signal source to an associated control line, the number of control lines corresponding to the number of keys in the group. The signal source is connected to each group in all of the manuals in sequence. A priority circuit connects all the control lines to a corresponding number of output lines, the priority circuit coupling the signal on only one of the control lines to its associated output lines when more than one key in a group is operated at any one time. Switching logic means responsive to a digitally coded input identifying any one of a plurality of possible chords connects the single output of the priority circuit to selected ones of a group of output lines corresponding in number to the number of keys in an octave. The pattern of signals on the output lines in turn designates the notes in each octave which are to be generated by the tone generators.

DESCRIPTION OF THE DRAWINGS

For a more complete understanding of the invention, reference should be made to the accompanying drawings, wherein.

DETAILED DESCRIPTION

The present invention is described as an improvement in the circuit of the keyboard switch detect and assignor circuit described in the above-identified U.S. Pat. No. 4,022,098 and incorporated in the present disclosure by reference. Portions of the circuit shown in the FIGS. which are identical to the disclosure in the pending application are identified by the same reference numbers.

Figure 1:
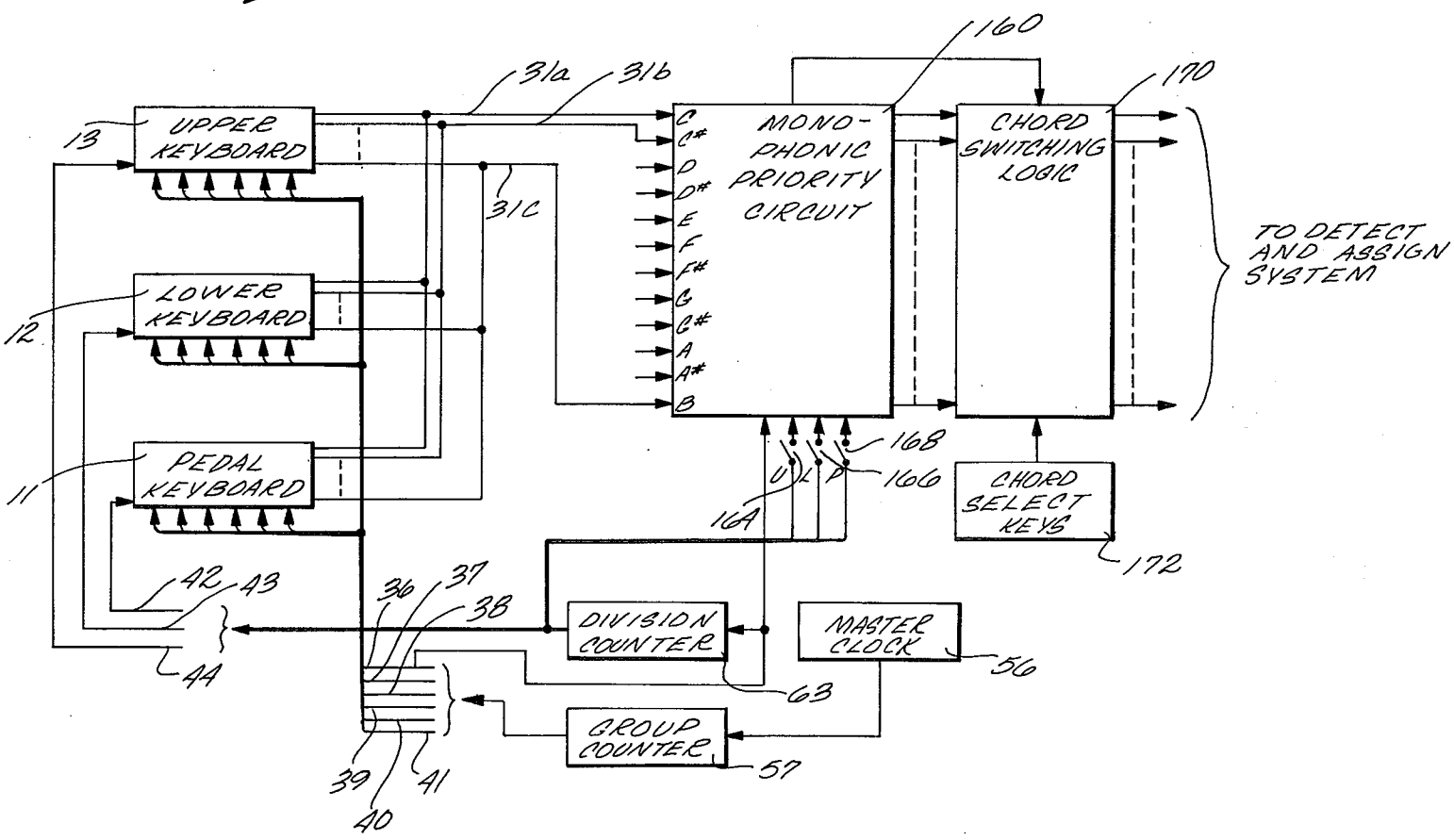
FIG. 1 is a schematic block diagram of the keyboard switch detect and assignor circuit incorporating the automatic chord generator of the present invention.

Referring to FIG. 1, the instrument keyboard is shown as consisting of three manuals or divisions, a pedal keyboard 11, a lower keyboard 12, and an upper keyboard 13. Each keyboard consists of a plurality of keys arranged in the conventional even-tempered scale of twelve notes to the octave. Each keyboard typically includes six octaves. Each key, when depressed, closes a normally-open switch.

As described in detail in the above-identified patent no. 4,022,098, the three keyborads are activated sequentially by the output of Division counter 63 over respective input lines 42, 43, and 44. The switches corresponding to each octave, comprising the twelve notes C through B of the standard musical scale, are connected as a group to one output of a Group counter 57 by means of lines 36, 37, 38, 39, 40 and 41 which are pulsed sequentially by the Group counter 57 in response to clock pulses from a master clock 56. The Division counter 63 in turn is advanced with each count cycle of the Group counter 57 in response to the timing signal on line 36. Thus each group of key-operated switches in the three keyboards are activated in sequence. Each of the key-operated switches in turn is connected to an associated one of a corresponding number of output control lines 31*a*, 31*b* . . . 31*l*, corresponding to the twelve notes in each octave. Thus if two keys representing the same note in two different octaves are actuated at the same time, the Group counter will provide an output signal on the same output line at two different times identifying which octave and which keyboard is involved. If two notes within the same octave are depressed at the same time, the same signal from the Group counter 57 will appear on two different output control lines at the same time, corresponding to the notes of the depressed keys.

The twelve output control lines 31*a* . . . 31*l* are applied to a monophonic priority circuit 160. The priority circuit 160 has the same number of output lines as input lines. The priority circuit functions to provide an output signal on only one of the output lines at a time in response to an input signal on one or more of the input lines. The priority of the circuit is arranged such that only the lowest one of a plurality of notes in a given octave where keys have been simultaneously depressed by the person playing the instrument is switched by the priority circuit to the corresponding output line. Control switches 164, 166, and 168 selectively activate the monophonic priority circuit 160 for any one of the three keyboards in response to the division signals derived from the Division counter 63 on lines 42, 43, and 44. The priority circuit 160 operates to limit keyboard signals from any one or all of the keyboards, depending upon the setting of the switches 164, 166, and 168 to a single output signal corresponding to the lowest pitch key depressed on the particular keyboard. Thus even though more than one key may be depressed on a particular keyboard within an octave, resulting in multiple signals on the input to the monophonic priority circuit 160, a signal is generated on only one of twelve output lines corresponding to the twelve tones in the octave.

The output lines from the monophonic priority circuit 160 are connected to a chord switching logic 170. Chord select keys 172 are designed to select any one of a number of standard chords, for example, a major chord, a minor chord, a seventh chord, a diminished chord, etc. The switching logic 170 in response to the output of the priority circuit 160 and the chord selected by the chord select keys 172 switches the input signal on any one of the lines from the priority circuit 160 to appropriate ones of a group of twelve output lines using the signal input lines as defining the root note of the chord. The signals on the output lines from the switching logic 170 are stored in a group of twelve shift registers in the manner described in detail in the above-identified U.S Pat. No. 4,022,098.

Figure 2:
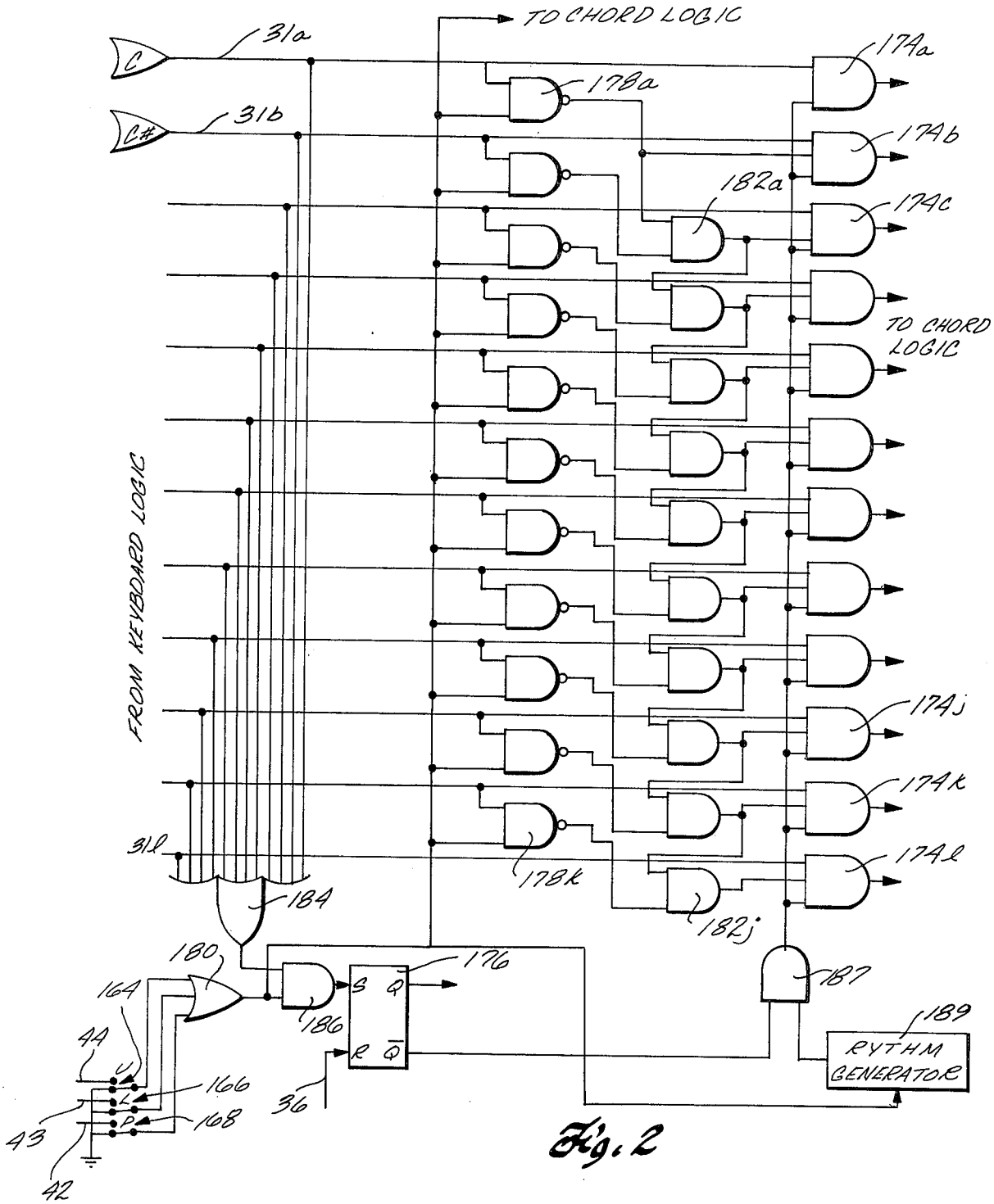
FIG. 2 is a logical block diagram of the priority circuit and associated control.

Details of the monophonic priority circuit 160 are shown in FIG. 2. Each of the twelve input lines 31*a* through 31*l* from the keyborad logic are connected as one input to a corresponding number of associated AND gates 174*a* through 174*l*. A second input to each of the AND gates 174*a* - 174*l* are connected to one input of a flip-flop 176. The flip-flop 176 is normally reset by pulses on the line 36 from the Group counter 57, the same pulse which resets the Division counter 63. Thus the flip-flop 176 is always reset at the start of a keyboard readout cycle.

The priority logic includes eleven NAND gates 178*a* through 178*l*. One input of each of the NAND gates is connected to the corresponding ones of the input lines 31*a* through 31*l*. The second input to each of the NAND gates 178*a* - 178*l* is connected to the output of an OR gate 180 to which each of the switches 164, 166, and 168 are connected. Thus if any one of the upper, lower, or pedal keyboards is selected for automatic chord generation by appropriately setting one of the three switches 164, 166 and 168, any one of the NAND gates associated with one of the input lines 31*a* - 31*l* on which a signal is received from the keyboard has the output set to 0.

The output of the NAND gate 178*a* is connected to a third input of the AND gate 174*b*. If a signal is received on the input line 31*a*, the AND gate 174*b* is turned off by the output of the NAND gate 178*a*, thereby blocking any output signal derived from the input line 31*b*. The remaining AND gates 174*c* through 174*l* are controlled by a chain of AND gates 182*a* through 182*j*. These outputs are connected respectively to inputs of the AND gates 174*c* through 174*l*. One input to each of the AND gates 182*a* through 182*j* is connected to a corresponding one of the outputs of the NAND gates 178*b* through 178*j*. Thus a priority circuit is established which assigns highest priority to the input line 31*a* and the lowest priority to the input line 31*l*. An input signal of any of the input lines turns off all the lower priority output AND gates 174, insuring that only a single output signal is provided from the highest priority input line.

All of the input lines 31*a* through 31*l* are applied to the input of an OR gate 184. The outputs of the OR gates 180 and 184 are applied to an AND gate 186, the output of which causes the flip-flop 176 to be switched to the Set state, therby turning off all the output AND gates 174*a* - 174*l*. This circuit arrangement operates to insure that priority is assigned to the lowest octave in the keyboard selected for chord operation, since each octave is activated in sequence starting with the lowest octave in the keyboard by the Group counter 57. As noted, the flip-flop 176 is reset when the Division counter 63 is incremented and operation is switched to the next keyboard in sequence. The output from the flip-flop 176 may be coupled to the AND gates 174*a* - 174*l* through an AND gate 187. A rhythm genertor 189 is coupled to the input to the AND gate 187. The rhythm generator 189, by generating pulses at any selected multiple of the signale from the OR gate 180, activates the AND gates only at intervals corresponding to the rhythm interval at which the chord is to be played.

Figure 3:
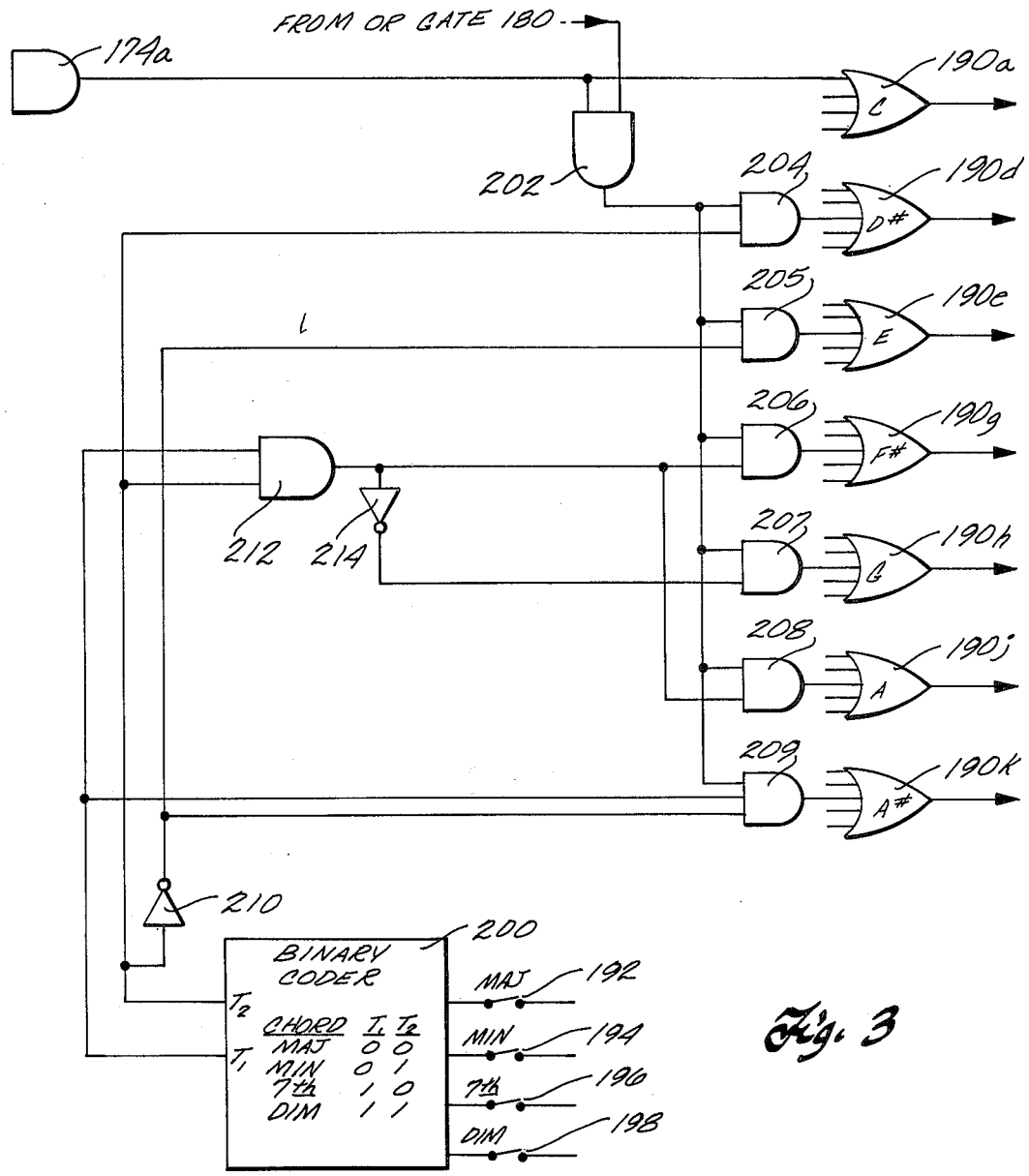
FIG. 3 is a logical block diagram of the chord generating control.

Referring to FIG. 3, there is shown a portion of the switching logic for generating four chords, the major chord, the minor chord, the seventh and diminished chords for one root note. It will be understood that the logic is duplicated for the remainder of the twelve notes of an octave. It should also be noted that for higher notes in the octave, the chord position is inverted so that all the notes in the generated chord remain within the same octave group.

The output lines from the AND circuit 174*a* through 174*l*, are connected to one input of a corresponding number of OR gates, seven of which are indicated at 190*a*, 190*d*, 190*e*, 190*g*, 190*h*, 190*j*, and 190*k*, corresponding to the notes used in forming the four specified chords using the note C as the root. The root note C, of course, indicated by the signal at the output of the OR gate 190*a*, is present in all four chords. The remaining notes of the chord are generated in response to a group of manually operated switches 192, 194, 196, and 198 by which the performer can select the desired chord. A binary coder 200 in response to the setting of one of the switches, sets the level on two output lines $T_1$,$T_2$ according to the truth table indicated.

When a signal is received for a root note from the priority circuit 160, such as from the output of the AND gate 174*a*, it is applied as one input to and AND gate 202 together with the output from the OR circuit 180 (see FIG. 2). The output from the AND gate 202 is applied to each of a group of AND gates 204 through 209 whose outputs are connected respectively to appropriate ones of the OR gates 190*a* - 190*l* corresponding to the notes required to form each of the four chords. The second input to the AND gate 204 is connected to $T_2$ from the binary coder 200, so that a signal from OR gate 190*d*, corresponding to the note D♯, is provided only for the minor and diminished chords. The output $T_2$ is coupled through an inverter 210 to the AND gate 205 so that a signal from OR gate 190*e*, corresponding to the note E, is generated only for the major and seventh chords. The line $T_1$ and $T_2$ are applied to the input of an AND circuit 212 which in turn is connected to the AND gate 206, so that a signal from OR gate 190*g*, corresponding to the note F#, is generated only for the diminished chord. The output of the AND circuit 212 is connected through an inverter 214 to the AND gate 207, so that a signal from OR gate 190*h*, corresponding to the note G, is generated for all but the diminished chord. The AND gate 208 receives both the $T_1$ and $T_2$ signals so as to generate a signal from OR gate 190*j*, corresponding to the A note, only for the diminished chord. Finally, the AND gate 209 senses when the $T_1$ line is 1 and the $T_2$ line is 0 to generate a signal from OR gate 190*k*, corresponding to the A# note, only for the seventh chord.

By duplicating the logic for the other root notes, the same four chords can be generated in the form of output signals by appropriate ones of the twelve output lines from the chord switching logic. The signals from these lines are stored in a corresponding number of registers in a manner described in the above-identified copending application. Thus it will be seen that an automatic chord generation system is provided by which actuating a single key on any selected keyboard can be used to generate any selected one of a number of basic chords within the octave containing the selected key. Regardless of how many keys are selected in a particular keyboard, only the lowest key results in the generation of chord information.

What is claimed is:

1. In a keyboard instrument having a plurality of keys and a plurality of note selection switches, each key actuating one of said note selection switches, apparatus for generating predetermined chords in response to actuating a single key comprising: means connecting the note selection switches in groups, the switches in each group corresponding to the notes in one octave, means including the switches in each group for selectively connecting a signal to an associated one of a plurality of output lines when a key in the group is operated, there being one output line for each note in the group, input chord control means generating signals coded to indicate a selected one of a plurality of different types of musical chords, switching logic means responsive to a signal on any one of said output lines and to the coded signals indicating a particular type of chord for selectively coupling said signal on one of said output lines to particular additional ones of said output lines corresponding to the notes in the particular chord, and means responsive to the signals on said output lines for generating corresponding tones within an octave.

2. Apparatus of claim 1 further comprising a priority circuit suppressing the signals on all but one of said output lines according to a predetermined note priority when more than one key-operated switch is operated at a time.

3. Apparatus of claim 2 wherein the key-operated switches in different groups of keys are activated sequentially.

4. Apparatus of claim 3 wherein the priority circuit further includes means for suppressing signals on all of the output lines following a signal to said one output line.

5. Apparatus of claim 1 further including a rhythm clock source, and means responsive to the clock source for periodically interrupting the transfer of any signals on the output lines.

6. In a keyboard instrument in which ech key operates a single switch of a plurality of switches and the status of the switches are examined in groups corresponding to the octaves of the keyboard, each group of switches time-sharing a group of output lines with one line for each switch in a group, the status of each switch in a group being indicated by a binary signal on an associated one of the output lines, apparatus for generating a chord in response to actuating any key on the keyboard comprising: chord control means generating a group of signals coded to indicate any one of a plurality of chord types, switching logic means responsive to the coded signals from said chord control means and the key initiated binary signals on said output lines for changing the binary status on selected ones of said output lines to correspond to the pattern of notes in the chord, and means coupled to the output lines for storing said pattern of output signals as each group of keys is examined.

* * * * *